US011435084B2

(12) United States Patent
Wright

(10) Patent No.: US 11,435,084 B2
(45) Date of Patent: Sep. 6, 2022

(54) CONTROL KNOB LOCKOUT DEVICE

(71) Applicant: Richard Wright, Los Angeles, CA (US)

(72) Inventor: Richard Wright, Los Angeles, CA (US)

( * ) Notice: Subject to any disclaimer, the term of this patent is extended or adjusted under 35 U.S.C. 154(b) by 304 days.

(21) Appl. No.: 16/802,765

(22) Filed: Feb. 27, 2020

(65) Prior Publication Data

US 2021/0270466 A1 Sep. 2, 2021

(51) Int. Cl.
*F24C 15/36* (2006.01)
*F24C 3/12* (2006.01)

(52) U.S. Cl.
CPC ..... *F24C 3/124* (2013.01); *F24C 15/36* (2013.01)

(58) Field of Classification Search
CPC ..... F24C 3/124; F24C 15/36
USPC ..... 126/42; 292/281, DIG. 17; 403/104; 108/40
See application file for complete search history.

(56) References Cited

U.S. PATENT DOCUMENTS 2,390,234 A 12/1945 Applebaum
2,699,162 A * 1/1955 Nazzaro ..... F24C 15/36 126/211
3,789,823 A 2/1974 Doskocil
4,134,386 A * 1/1979 Miguel ..... F24C 3/124 126/42
4,852,920 A * 8/1989 DeForrest, Sr. ..... E05B 67/38 292/281
4,922,888 A 5/1990 Bryan
6,053,547 A * 4/2000 Lemieux ..... E05B 65/0894 292/281
6,371,105 B1 4/2002 Merritt
7,401,610 B1 7/2008 Cherry
D653,900 S 2/2012 Kim
2005/0279348 A1 12/2005 Cheng

* cited by examiner

*Primary Examiner* — Avinash A Savani

(57) ABSTRACT

A control knob lockout device for rendering knobs of a stove inoperable includes a pair of latches, a pair of keepers, and a housing. The latches are mountable to a stove so that the latches are positioned singly proximate to opposed sides of the stove. The latches also are positioned in substantial alignment with a set of control knobs that is engaged to a surface of the stove. The housing defines an interior space and has a rear face. The rear face has an opening positioned therein to insert the set of control knobs so that the housing is positioned thereover. The pair of keepers is engaged to a front face of the housing. Each keeper is positioned proximate to a respective opposed end of the housing and selectively engages a respective latch to fixedly position the housing over the set of control knobs.

11 Claims, 4 Drawing Sheets

CONTROL KNOB LOCKOUT DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to lockout devices and more particularly pertains to a new lockout device for rendering knobs of a stove inoperable.

(2) Description of Related Art Including Information Disclosed Under 37 CFR 1.97 and 1.98

The prior art relates to lockout devices. Prior art knob lockout devices may comprise a shield having one or more selectively openable ports positioned therein, or a shield hingedly coupled to a stove.

BRIEF SUMMARY OF THE INVENTION

An embodiment of the disclosure meets the needs presented above by generally comprising a pair of latches, a pair of keepers, and a housing. The latches are configured to be mountable to a stove so that the latches are positioned singly proximate to opposed sides of the stove. The latches also are positioned in substantial alignment with a set of control knobs that is engaged to a surface of the stove. The housing defines an interior space and has a rear face. The rear face has an opening positioned therein, which is configured to insert the set of control knobs so that the housing is positioned thereover. The pair of keepers is engaged to a front face of the housing. Each keeper is positioned proximate to a respective opposed end of the housing and is configured to selectively engage a respective latch to fixedly position the housing over the set of control knobs.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
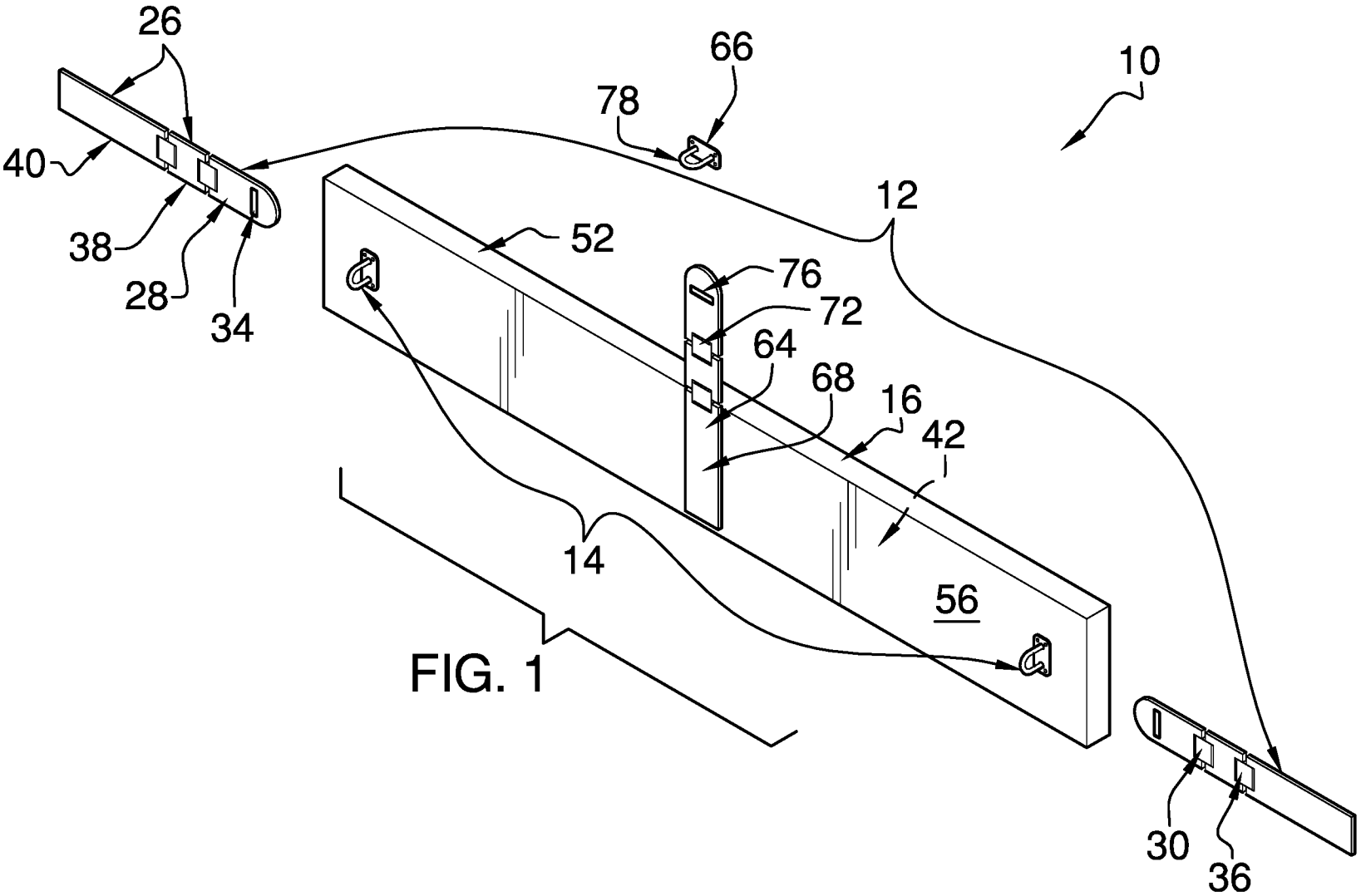
FIG. 1 is an exploded view of a control knob lockout device according to an embodiment of the disclosure.

With reference now to the drawings, and in particular to FIGS. 1 through 5 thereof, a new lockout device embodying the principles and concepts of an embodiment of the disclosure and generally designated by the reference numeral 10 will be described.

Figure 5:
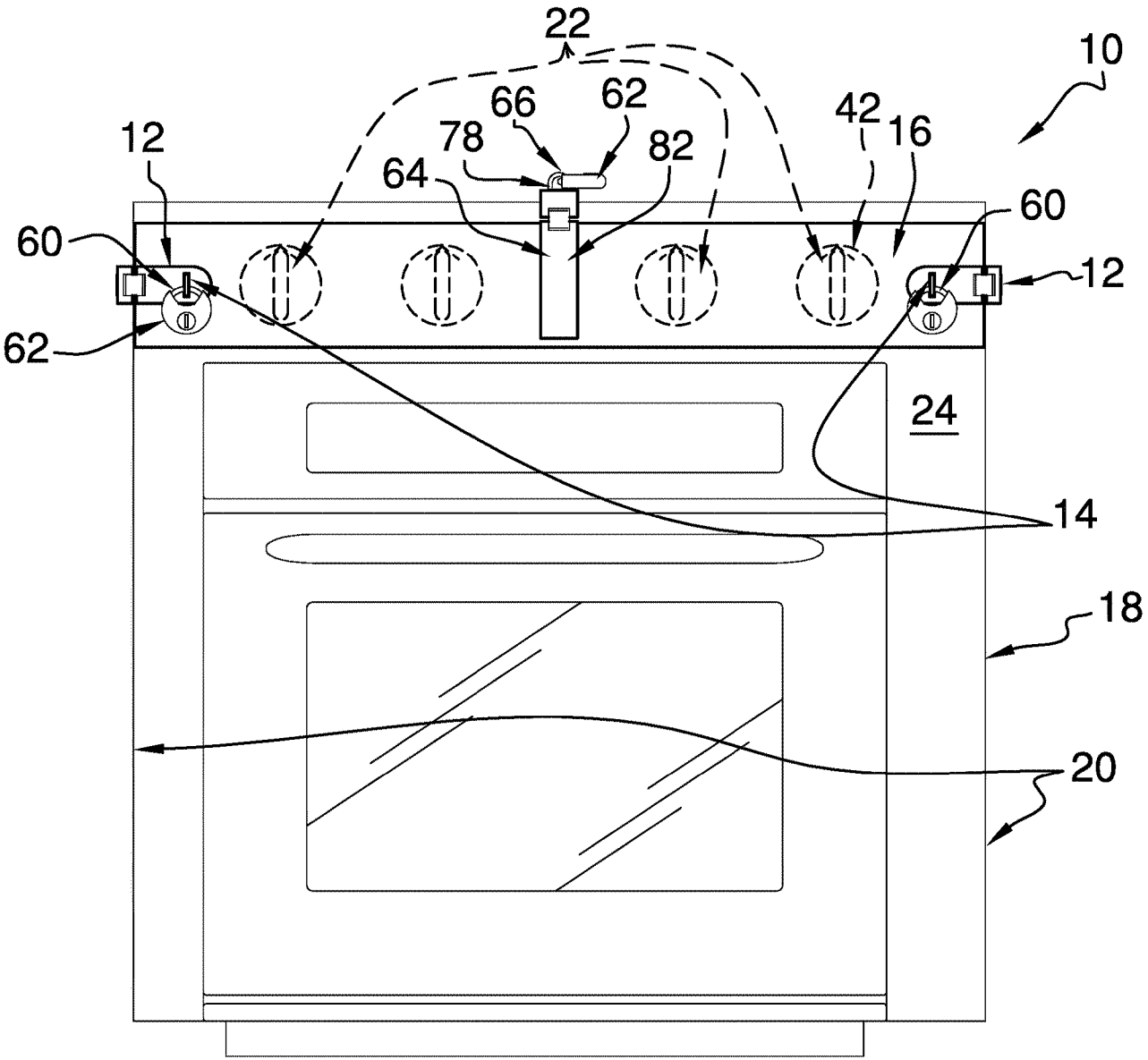
FIG. 5 is an in-use view of an embodiment of the disclosure.

As best illustrated in FIGS. 1 through 5, the control knob lockout device 10 generally comprises a pair of latches 12, a pair of keepers 14, and a housing 16. The latches 12 are configured to be mountable to a stove 18 so that the latches 12 are positioned singly proximate to opposed sides 20 of the stove 18. The latches 12 also are positioned in substantial alignment with a set of control knobs 22 that is engaged to a surface 24 of the stove 18, as shown in FIG. 5.

The present invention anticipates the latches 12 being mounted to the stove 18 by various methods, such as, but not limited to, adhesive coupling, welding, bolting, and the like.

Figure 2:
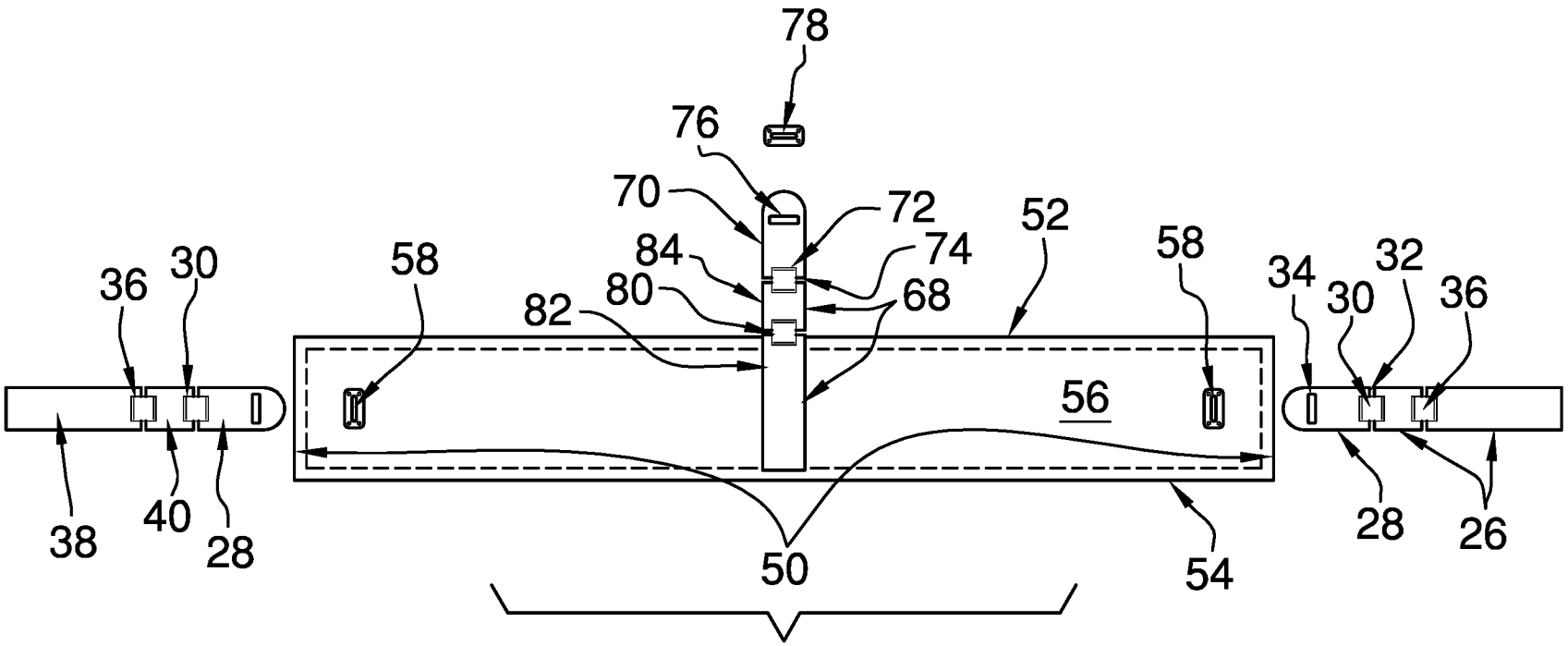
FIG. 2 is a front view of an embodiment of the disclosure.
Figure 4:
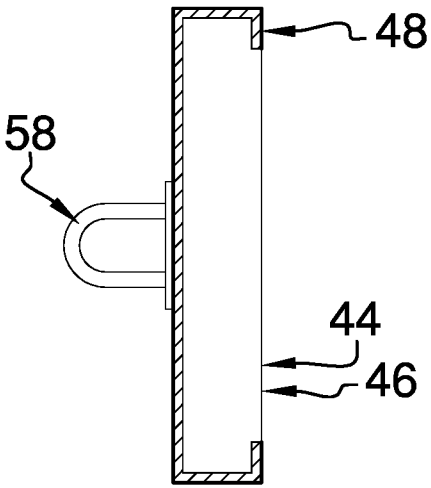
FIG. 4 is a cross-sectional view of an embodiment of the disclosure.

Each latch 12 comprises a first section 26, a second section 28, and a first hinge 30, as shown in FIG. 2. The first section 26 is configured to be mountable to the stove 18 so that a first terminus 32 of the first section 26 extends from the stove 18 proximate to the set of control knobs 22. The first hinge 30 is engaged to the first terminus 32 of the first section 26. The second section 28 also is engaged to the first hinge 30 and has a slot 34 positioned therein distal from the first hinge 30. As will become apparent, the second section 28 being hingedly coupled to the first section 26 allows the second section 28 to be hinged to a position allowing for the slot 34 to engage a respective keeper 14.

Each latch 12 also may comprise a second hinge 36, which is positioned in the first section 26. The second hinge 36 defines a first subsection 38 and a second subsection 40 of the first section 26, as shown in FIG. 2. The second hinge 36 is positioned proximate to the surface 24 of the stove 18 when the first subsection 38 is mounted to the stove 18, positioning the second hinge 36 to be hinged to selectively position the second subsection 40 and the second section 28 in substantial abutment with the first subsection 38. The second hinge 36 thus allows the first subsection 38 to be positioned so that it does not protrude from the surface 24 of the stove 18.

Figure 3:
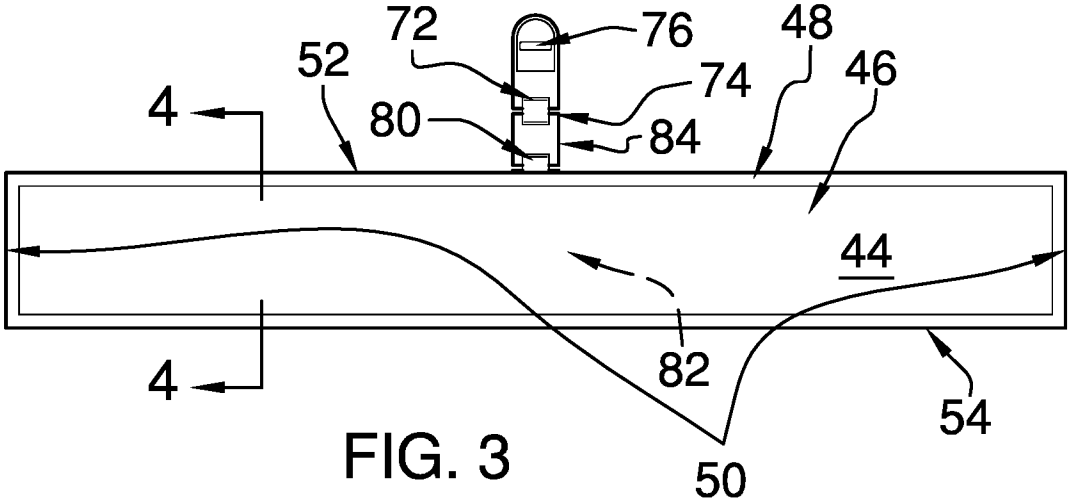
FIG. 3 is a rear view of an embodiment of the disclosure.

The housing 16 defines an interior space 42 and has a rear face 44. The rear face 44 has an opening 46 positioned therein, which is configured to insert the set of control knobs 22 so that the housing 16 is positioned thereover. The opening 46 defines a rim 48, which extends from opposed ends 50, a top 52, and a bottom 54 of the housing 16 into the rear face 44, as shown in FIG. 3. The rim 48 is configured to abut the surface 24 of the stove 18, when the housing 16 is positioned over the set of control knobs 22, to stabilize the housing 16 relative to the stove 18.

The pair of keepers 14 is engaged to a front face 56 of the housing 16, as shown in FIG. 2. Each keeper 14 is positioned proximate to a respective opposed end 50 of the housing 16 and is configured to selectively engage a respective latch 12 to fixedly position the housing 16 over the set of control knobs 22, as shown in FIG. 5.

Each keeper 14 may comprise a locking eye 58. A respective slot 34 is positioned to insert the locking eye 58, which then is configured to insert a shackle 60 of a respective padlock 62 to selectively secure the housing 16 to the stove 18 to render the set of control knobs 22 inaccessible.

The device 10 also may comprise a hasp 64 and a strike 66. The hasp 64 is engaged to the housing 16 and is positioned substantially equally distant from the opposed ends 50 of the housing 16. The strike 66 is configured to be mountable to the stove 18 proximate to the set of control knobs 22, so that the strike 66 is positioned substantially equally distant from the opposed sides 20 of the stove 18. The strike 66 is configured to selectively engage the hasp 64 to fixedly position the housing 16 over the set of control knobs 22.

The hasp 64 comprises a first segment 68, a second segment 70, and a primary hinge 72. The first segment 68 is engaged to the front face 56 the housing 16 so that a first endpoint 74 of the first segment 68 extends past the top 52 of the housing 16. The primary hinge 72 is engaged to the first endpoint 74 of the first segment 68. The second segment 70 also is engaged to the primary hinge 72 and has an aperture 76 positioned therein distal from the primary hinge 72. The strike 66 may comprise a locking ring 78, which is insertable into the aperture 76. The locking ring 78 is configured to insert a shackle 60 of a respective padlock 62 to selectively secure the housing 16 to the stove 18 to render the set of control knobs 22 inaccessible.

When the latches 12 are not engaged to the keepers 14 to secure the housing 16 in place, the first segment 68 of the hasp 64 being hingedly coupled to the second segment 70 allows the housing 16 to be hinged relative to the surface 24 of the stove 18 to expose the set of control knobs 22.

The hasp 64 may comprise a secondary hinge 80, which is positioned in the first segment 68. The secondary hinge 80 defines a first subsegment 82 and a second subsegment 84 of the first segment 68. The first subsegment 82 is engaged to the housing 16 so that the secondary hinge 80 is positioned proximate to the top 52 of the housing 16. The secondary hinge 80 is positioned to be hinged to selectively position the second subsegment 84 and the second segment 70 in substantial abutment with the first subsegment 82.

In use, the set of control knobs 22 is inserted through the opening 46 into the interior space 42 of the housing 16. The latches 12 are hinged to so that each slot 34 has a respective locking eye 58 inserted therethrough. Each locking eye 58 then has a shackle 60 of a respective padlock 62 inserted therethrough to secure the housing 16 to the stove 18 to prevent unauthorized use of the control knobs 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A control knob lockout device comprising:

a pair of latches configured to be mountable to a stove, such that the latches are positioned singly proximate to opposed sides of the stove and in substantial alignment with a set of control knobs engaged to a surface of the stove;

a housing defining an interior space, the housing having a rear face, the rear face having an opening positioned therein, wherein the opening is configured for inserting the set of control knobs such that the housing is positioned. thereover; and a pair of keepers engaged to a front face of the housing, each keeper being positioned proximate to a respective opposed end of the housing and being configured for selectively engaging a respective latch for fixedly positioning the housing over the set of control knobs;

wherein each latch comprises:

a first section configured to be mountable to the stove, such that a first terminus of the first section extends from the stove proximate to the set of control knobs, a first hinge engaged to the first terminus of the first section, and a second section engaged to the first hinge, the second section having a slot positioned therein distal from the first hinge;

wherein each keeper comprises a locking eye, such that a respective slot is positioned for inserting the locking eye, wherein the locking eye is configured for inserting a shackle of a respective padlock for selectively securing the housing to the stove for rendering the set of control knobs inaccessible; and a second hinge positioned in the first section defining a first subsection and a second subsection of the first section, such that the second hinge is positioned proximate to the surface of the stove when the first subsection is mounted to the stove, positioning the second hinge for hinging for selectively positioning the second subsection and the second section in substantial abutment with the first subsection.

2. The control knob lockout device of claim 1, wherein the opening defines a rim extending from opposed ends, a top, and a bottom of the housing into the rear face, wherein the rim is configured for abutting the surface of the stove when the housing is positioned over the set of control knobs, for stabilizing the housing relative to the stove.

3. The control knob lockout device of claim 1, further including:

a hasp engaged to the housing substantially equally distant from the opposed ends of the housing; and a strike configured to be mountable to the stove proximate to the set of control knobs, such that the strike is positioned substantially equally distant from the opposed sides of the stove, the strike being configured for selectively engaging the hasp for fixedly positioning the housing over the set of control knobs.

4. A control knob lockout device comprising:

a pair of latches configured to be mountable to a stove, such that the latches are positioned singly proximate to opposed sides of the stove and in substantial alignment with a set of control knobs engaged to a surface of the stove;

a housing defining an interior space, the housing having a rear face, the rear face having an opening positioned therein, wherein the opening is configured for inserting the set of control knobs such that the housing is positioned thereover;

a pair of keepers engaged to a front face of the housing, each keeper being positioned proximate to a respective opposed end of the housing and being configured for selectively engaging a respective latch for fixedly positioning the housing over the set of control knobs;

a hasp engaged to the housing substantially equally distant from the opposed ends of the housing;

a strike configured to be mountable to the stove proximate to the set of control knobs, such that the strike is positioned substantially equally distant from the opposed sides of the stove, the strike being configured for selectively engaging the hasp for fixedly positioning the housing over the set of control knobs;

wherein the hasp comprises:

a first segment engaged to the front face the housing, such that a first endpoint of the first segment extends past the top of the housing, a primary hinge engaged to the first endpoint of the first segment, and a second segment engaged to the primary hinge, the second segment having an aperture positioned therein distal from the primary hinge; and the strike comprises a locking ring, such that the aperture is positioned for inserting the locking ring, wherein the locking ring is configured for inserting a shackle of a respective padlock for selectively securing the housing to the stove for rendering the set of control knobs inaccessible.

5. The control knob lockout device of claim 4, further including a secondary hinge positioned in the first segment defining a first subsegment and a second subsegment of the first segment, the first subsegment being engaged to the housing such that the secondary hinge is positioned proximate to a top of the housing, positioning the secondary hinge for hinging for selectively positioning the second subsegment and the second segment in substantial abutment with the first subsegment.

6. A control nob lockout device and stove combination comprising:

a stove having a set of control knobs engaged to a surface thereof;

a pair of latches mounted singly to opposed sides of the stove, such that the latches are positioned in substantial alignment with the set of control knobs;

a housing defining an interior space, the housing having a rear face, the rear face having an opening positioned therein, such that the set of control knobs is selectively insertable into the opening for positioning the housing thereover; and a pair of keepers engaged to a front face of the housing, each keeper being positioned proximate to a respective opposed end of the housing and being configured for selectively engaging a respective latch for fixedly positioning the housing over the set of control knobs;

wherein each latch comprises:

a first section configured to be mountable to the stove, such that a first terminus of the first section extends from the stove proximate to the set of control knobs, a first hinge engaged to the first terminus of the first section, and a second section engaged to the first hinge, the second section having a slot positioned therein distal from the first hinge;

wherein each keeper comprises a locking eye, such that a respective slot is positioned for inserting the locking eye, wherein the locking eye is configured for inserting a shackle of a respective padlock for selectively securing the housing to the stove for rendering the set of control knobs inaccessible; and a second hinge positioned in the first section defining a first subsection and a second subsection of the first section, such that the second hinge is positioned proximate to the surface of the stove when the first subsection is mounted to the stove, positioning the second hinge for hinging for selectively positioning the second subsection and the second section in substantial abutment with the first subsection.

7. The control knob lockout device and stove combination of claim 6, wherein the opening defines a rim extending from opposed ends, a top, and a bottom of the housing into the rear face, wherein the rim is configured for abutting the surface of the stove when the housing is positioned over the set of control knobs, for stabilizing the housing relative to the stove.

8. The control knob lockout device and stove combination of claim 6, further including:

a hasp engaged to the housing substantially equally distant from the opposed ends of the housing; and a strike configured to be mountable to the stove proximate to the set of control knobs, such that the strike is positioned substantially equally distant from the opposed sides of the stove, the strike being configured for selectively engaging the hasp for fixedly positioning the housing over the set of control knobs.

9. A control knob lockout device and stove combination comprising:

a stove having a set of control knobs engaged to a surface thereof;

a pair of latches mounted singly to opposed sides of the stove, such that the latches are positioned in substantial alignment with the set of control knobs;

a housing defining an interior space, the housing having a rear face, the rear face having an opening positioned therein, such that the set of control knobs is selectively insertable into the opening for positioning the housing thereover;

a pair of keepers engaged to a front face of the housing, each keeper being positioned proximate to a respective opposed end of the housing and being configured for selectively engaging a respective latch for fixedly positioning the housing over the set of control knobs;

a hasp engaged to the housing substantially equally distant from the opposed ends of the housing;

a strike configured to be mountable to the stove proximate to the set of control knobs, such that the strike is positioned substantially equally distant from the opposed sides of the stove, the strike being configured for selectively engaging the hasp for fixedly positioning the housing over the set of control knobs;

wherein the hasp comprises:

a first segment engaged to the front face the housing, such that a first endpoint of the first segment extends past the top of the housing, a primary hinge engaged to the first endpoint of the first segment, and a second segment engaged to the primary hinge, the second segment having an aperture positioned therein distal from the primary hinge; and the strike comprises a locking ring, such that the aperture is positioned for inserting the locking ring, wherein the locking ring is configured for inserting a shackle of a respective padlock for selectively securing the housing to the stove for rendering the set of control knobs inaccessible.

10. The control knob lockout device and stove combination of claim 9, further including a secondary hinge positioned in the first segment defining a first subsegment and a second subsegment of the first segment, the first subsegment being engaged to the housing such that the secondary hinge is positioned proximate to a top of the housing, positioning the secondary hinge for hinging for selectively positioning the second subsegment and the second segment in substantial abutment with the first subsegment.

11. A control knob lockout device comprising:

a pair of latches configured to be mountable to a stove, such that the latches are positioned singly proximate to opposed sides of the stove and in substantial alignment with a set of control knobs engaged to a surface of the stove, each latch comprising:

a first section configured to be mountable to the stove, such that a first terminus of the first section extends from the stove proximate to the set of control knobs, a first hinge engaged to the first terminus of the first section, a second section engaged to the first hinge, the second section having a slot positioned therein distal from the first hinge, and a second hinge positioned in the first section defining a first subsection and a second subsection of the first section, such that the second hinge is positioned proximate to the surface of the stove when the first subsection is mounted to the stove, positioning the second hinge for hinging for selectively positioning the second subsection and the second section in substantial abutment with the first subsection;

a housing defining an interior space, the housing having a rear face, the rear face having an opening positioned therein, wherein the opening is configured for inserting the set of control knobs such that the housing is positioned thereover, the opening defining a rim extending from opposed ends, a top, and a bottom of the housing into the rear thee, wherein the rim is configured for abutting the surface of the stove When the housing is positioned over the set of control knobs, for stabilizing the housing relative to the stove;

a pair of keepers engaged to a front face of the housing, each keeper being positioned proximate to a respective opposed end of the housing and being configured for selectively engaging a respective latch for fixedly positioning the housing over the set of control knobs, each keeper comprising a locking eye, such that a respective slot is positioned for inserting the locking eye, wherein the locking eye is configured for inserting a shackle of a respective padlock for selectively securing the housing to the stove for rendering the set of control knobs inaccessible;

a hasp engaged to the housing substantially equally distant from the opposed ends of the housing, the hasp comprising:

a first segment engaged to the front face the housing, such that a first endpoint of the first segment extends past the top of the housing, a primary hinge engaged to the first endpoint of the first segment, a second segment engaged to the primary hinge, the second segment having an aperture positioned therein distal from the primary hinge, and a secondary hinge positioned in the first segment defining a first subsegment and a second subsegment of the first segment, the first subsegment being engaged to the housing such that the secondary hinge is positioned proximate to the top of the housing, positioning the secondary hinge for hinging for selectively positioning the second subsegment and the second segment in substantial abutment with the first subsegment; and a strike configured to be mountable to the stove proximate to the set of control knobs, such that the strike is positioned substantially equally distant from the opposed sides of the stove, the strike being configured for selectively engaging the hasp for fixedly positioning the housing over the set of control knobs, the strike comprising a locking ring, such that the aperture is positioned for inserting the locking ring, wherein the locking ring is configured for inserting a shackle of a respective padlock for selectively securing the housing to the stove for rendering the set of control knobs inaccessible.

* * * * *